US011400708B2

(12) United States Patent
Uchida et al.

(10) Patent No.: US 11,400,708 B2
(45) Date of Patent: Aug. 2, 2022

(54) LIQUID EJECTING APPARATUS

(71) Applicant: SEIKO EPSON CORPORATION, Tokyo (JP)

(72) Inventors: Kazuaki Uchida, Fujimi-machi (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 16/914,882

(22) Filed: Jun. 29, 2020

(65) Prior Publication Data

US 2021/0001627 A1 Jan. 7, 2021

(30) Foreign Application Priority Data

Jul. 1, 2019 (JP) ..... JP2019-122732

(51) Int. Cl.
*B41J 2/045* (2006.01)

(52) U.S. Cl.
CPC ..... *B41J 2/04573* (2013.01); *B41J 2/04541* (2013.01); *B41J 2/04581* (2013.01)

(58) Field of Classification Search
CPC ..... B41J 2/04581
See application file for complete search history.

(56) References Cited

U.S. PATENT DOCUMENTS 9,162,503 B2 * 10/2015 Monteiro ..... B41J 3/40733
2010/0102882 A1 * 4/2010 Yoshino ..... B41J 2/04588 330/251
2021/0008876 A1 * 1/2021 Takenaka ..... B41J 2/04581

FOREIGN PATENT DOCUMENTS

JP 2003-334941 A 11/2003

* cited by examiner

*Primary Examiner* — Shelby L Fidler
(74) *Attorney, Agent, or Firm* — Workman Nydegger

(57) ABSTRACT the ejection amount per ejection from the nozzle when the distance between the nozzle and the recording medium is the first distance is equal to the ejection amount per ejection from the nozzle when the distance between the nozzle and the recording medium is the second distance.

10 Claims, 3 Drawing Sheets

LIQUID EJECTING APPARATUS

The present application is based on, and claims priority from JP Application Serial Number 2019-122732, filed Jul. 1, 2019, the disclosure of which is hereby incorporated by reference herein in its entirety.

BACKGROUND

1. Technical Field

The present disclosure relates to a liquid ejecting apparatus.

2. Related Art

A technique for ejecting a liquid from nozzles onto a medium such as a print sheet has been proposed. When, for example, a medium is curled, the interval between the surface of the medium and each nozzle changes for each nozzle, and the position on the surface of the medium on which the liquid is to land may be an unintended position. For example, JP-A-2003-334941 discloses a configuration in which an ejection timing is changed depending on a distance between a head ejection face and a recording medium.

However, it is difficult for errors to be sufficiently reduced with the configuration of JP-A-2003-334941. For example, an apparent problem may occur when an interval between the head ejection face and the recoding medium changes to a large degree between two neighboring regions in the scanning direction. When a liquid is to be ejected onto each of the two regions at an appropriate ejection timing depending on the interval, the ejection timing at one of the two regions may overlap the ejection timing at the other thereof, and it is difficult to eject the liquid onto both the two regions under a desired condition. Consequently, the errors in the landing positions may not be sufficiently reduced by the change in the ejection timings.

SUMMARY

A liquid ejecting apparatus according to an aspect of the present disclosure includes a liquid ejecting head with a nozzle configured to eject a liquid, and a control section configured to control ejection of the liquid by the liquid ejecting head. The control section controls ejection of the liquid by the liquid ejecting head so that an ejection speed of the liquid from the nozzle is a first speed when a distance between the nozzle and a recording medium is a first distance, the ejection speed is a second speed higher than the first speed when the distance between the nozzle and the recording medium is a second distance greater than the first distance, and the ejection amount per ejection from the nozzle when the distance between the nozzle and the recording medium is the first distance is equal to the ejection amount per ejection from the nozzle when the distance between the nozzle and the recording medium is the second distance.

DESCRIPTION OF EXEMPLARY EMBODIMENTS

A: First Embodiment

Figure 1:
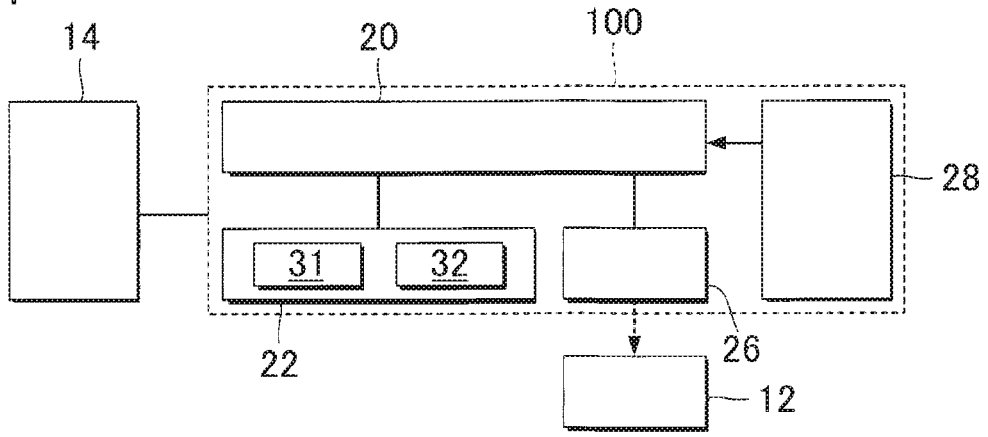
FIG. 1 is a block diagram of an exemplary configuration of a liquid ejecting apparatus according to a first embodiment.

FIG. 1 is a block diagram of an exemplary configuration of a liquid ejecting apparatus 100 according to a first embodiment. The liquid ejecting apparatus 100 is an ink jet printer configured to eject ink, which is an example of a liquid, onto a recording medium 12. The liquid is not limited to ink and may be a resin material in a liquid form, for example. A typical example of the recording medium 12 is a print sheet, but the recording medium 12 may be any printable material such as resin film or cloth fabric. As illustrated in FIG. 1, the liquid ejecting apparatus 100 is provided with a liquid container 14 configured to store ink. The liquid container 14 may be a cartridge attachable to and detachable from the liquid ejecting apparatus 100, a bag-shaped ink package made of a flexible film, or a refillable ink tank, for example.

As illustrated in FIG. 1, the liquid ejecting apparatus 100 includes a control unit 20, a movement mechanism 22, a liquid ejecting head 26, and a detection section 28. The control unit 20 includes one or more processing circuits such as a central processing unit (CPU) or a field programmable gate array (FPGA) and one or more memory circuits such as semiconductor memory, and collectively controls respective components in the liquid ejecting apparatus 100. The control unit 20 is an exemplary "control section".

Figure 2:
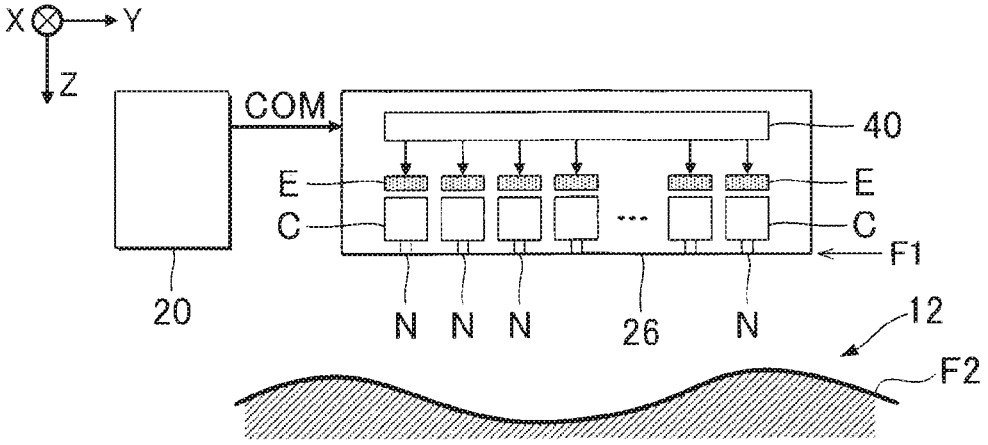
FIG. 2 is a diagram of a configuration of a liquid ejecting head.

The movement mechanism 22 moves the liquid ejecting head 26 and the recording medium 12. Specifically, the movement mechanism 22 includes a first movement section 31 and a second movement section 32. FIG. 2 is a sectional view of the liquid ejecting head 26 and the recording medium 12. As illustrated in FIG. 2, the first movement section 31 transports the recording medium 12 in the Y-axis direction under control of the control unit 20. The second movement section 32 moves the liquid ejecting head 26 forward and backward along the X-axis under control of the control unit 20. The X-axis crosses the Y-axis along which the recording medium 12 is transported. For example, the X-axis is perpendicular to the Y-axis. Specifically, the second movement section 32 includes a substantially box-shaped transport unit configured to house the liquid ejecting head 26, and a transport belt to which the transport unit is fixed. Two or more liquid ejecting heads 26 may be mounted on the transport unit, or the liquid container 14 and the liquid ejecting head 26 may be mounted together on the transport unit.

The liquid ejecting head 26 ejects an ink supplied from the liquid container 14 onto the recording medium 12 from nozzles N under control of the control unit 20. Each of the liquid ejecting heads 26 ejects the ink onto the recording medium 12 while the first movement section 31 transports the recording medium 12 and the transport unit reciprocates, and consequently a desired image is formed on a surface of the recording medium 12. An axis perpendicular to the X-Y plane will be denoted as the Z-axis in the following description. The X-Y plane is parallel to the surface of the recording medium 12, for example. The nozzles N eject the ink in the Z-axis direction.

As illustrated in FIG. 2, the liquid ejecting head 26 includes nozzles N, pressure chambers C, and drive elements E. The nozzles N are provided in the liquid ejecting head 26 on a surface (hereinafter referred to as "ejection face") F1 facing the recording medium 12. The ejection face F1 is a planar face parallel to the X-Y plane, for example.

A pressure chamber C and a drive element (energy generating element) E are formed per nozzle N. The pressure chamber C is a space communicating with the nozzle N. The pressure chambers C in the liquid ejecting head 26 are filled with ink supplied from the liquid container 14. The drive element E generates energy when powered, and varies the pressure of the ink in the pressure chamber C in accordance with the energy. For example, the drive element E may be implemented as a piezoelectric element configured to change the volume of a pressure chamber C by deforming the wall of the pressure chamber C or as a heat generating element configured to generate bubbles in a pressure chamber C by using the ink heated in the pressure chamber C. The drive element E varies the pressure of the ink in the pressure chamber C, and the ink in the pressure chamber C is then ejected from the nozzle N. The processing operations using a piezoelectric element will be described below. A piezoelectric element includes at least a piezoelectric body and two electrodes configured to be electrically coupled to the piezoelectric body.

As illustrated in FIG. 2, the liquid ejecting head 26 includes a drive circuit 40. The drive circuit 40 drives each of the drive elements E under control of the control unit 20. The control unit 20 generates a drive signal COM for driving the drive elements E and a holding signal VBS for applying a reference voltage to the drive elements E and supplies the drive signal COM and the holding signal VBS to the drive circuit 40. The drive signal COM varies in voltage over time whereas the holding signal VBS is always at a constant voltage. The drive circuit 40 applies the drive signal COM to one of the two electrodes of the drive element E and the holding signal VBS to the other of the two electrodes of the drive element E.

Figure 3:
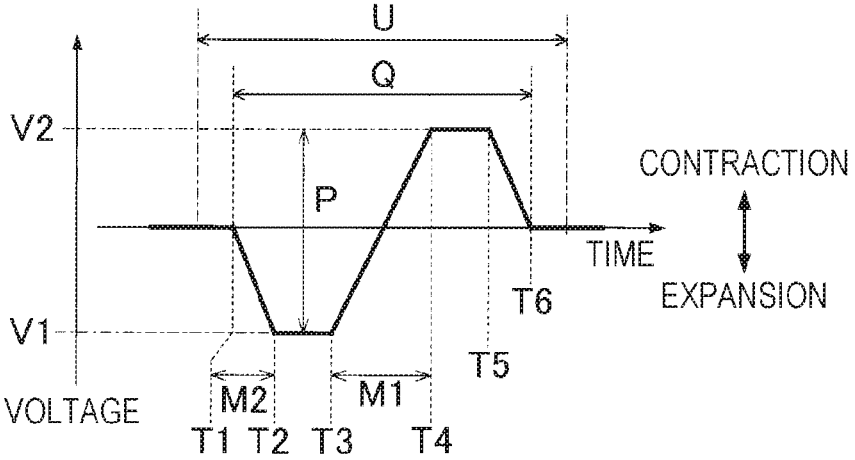
FIG. 3 is a diagram of a waveform of a drive signal.

FIG. 3 is a diagram for explaining a waveform (pulse) of the drive signal COM. FIG. 3 illustrates a waveform obtained by subtracting a voltage value of the holding signal VBS from a voltage value of the drive signal COM at each timing for simplicity. The waveform of FIG. 3 indicates that a value of the voltage is lower than an actual voltage value (constant reference voltage) of the drive signal COM by the subtracted reference voltage of the holding signal VBS but the voltage changes in the same way as the drive signal COM. As illustrated in FIG. 3, the drive signal COM is a voltage signal varying at a unit period U. The drive signal COM is shared for driving the drive elements E. The drive signal COM includes one or more drive waveforms Q per unit period U. The drive waveforms Q are pulses for driving the drive elements E.

Specifically, the drive waveform Q changes in voltage over time as follows. At first, the voltage starts decreasing from the reference voltage at a timing T1, and stops decreasing at a timing T2. The period from the timing T1 to the timing T2 is a period M2 in which the pressure chambers C expand. The voltage is at a constant voltage V1 in the period from the timing T2 to a timing T3.

The voltage then starts increasing at the timing T3 and stops increasing at a timing T4. The voltage increases beyond the reference voltage during the period. The period from the timing T3 to the timing T4 is a period M1 in which the pressure chambers C contract. The voltage is at a constant voltage V2 in the period from the timing T4 to a timing T5. Thereafter, the voltage starts decreasing again at the timing T5 and reaches the reference voltage at a timing T6.

The drive circuit 40 supplies the drive waveform Q to each of the drive elements E per unit period U. The drive elements E operate in response to the supply of the drive waveform Q, and the ink is ejected from the nozzles N corresponding to the drive elements E. That is, the drive waveform Q is a waveform to eject the ink from the nozzles N.

As illustrated in FIG. 2, the first embodiment assumes that a surface (hereinafter referred to as "landing face") F2 of the recording medium 12 is uneven. When the landing face F2 is uneven as described above, a position on the landing face F2 at which the ink ejected from the liquid ejecting head 26 is to land may deviate from an intended position. A position on the X-axis on the landing face F2 at which the ink is to land will be denoted as "landing position" in the following description.

Figure 4:
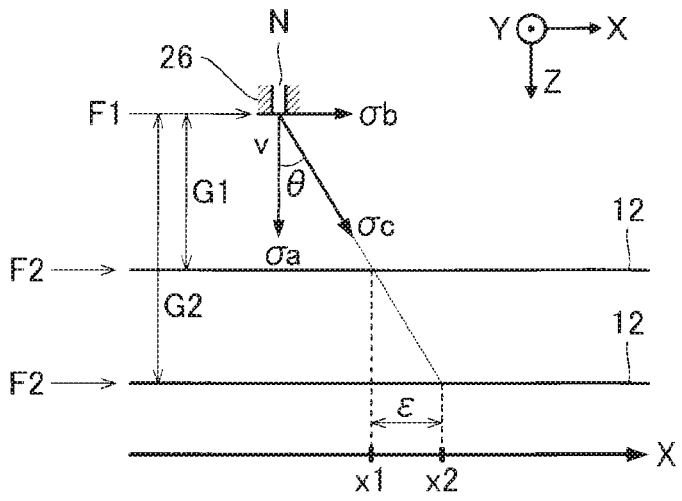
FIG. 4 is an explanatory diagram of an error of a landing position.

FIG. 4 is an explanatory diagram of an error ε of a landing position x. The following description will be made using one of the nozzles N in the liquid ejecting head 26. A distance G between the recording medium 12 and the nozzle N is illustrated in FIG. 4. Specifically, the distance G is a distance between a region of the ejection face F1 where the nozzle N is formed and a region facing the nozzle N of the landing face F2 of the recording medium 12. The distance G between the recording medium 12 and the nozzle N changes depending on the shape of the landing face F2. That is, the distance G may change due to the uneven landing face F2. For example, the distance G at a concave portion on the landing face F2 is greater than the distance G at a convex portion on the landing face F2. FIG. 4 illustrates a case in which the distance G is a first distance G1 and a case in which the distance G is a second distance G2 greater than the first distance G1. FIG. 4 illustrates a configuration (hereinafter referred to as "comparative example") in which a speed (hereinafter referred to as "ejection speed") v at which the ink is ejected from the nozzle N is constant irrespective of the distance G.

As described above, the liquid ejecting head 26 moves in the X-axis direction and the ink is ejected in the Z-axis direction. As illustrated in FIG. 4, a resultant vector σc of a vector σa (hereinafter referred to as "speed vector") of the ink ejection speed v in the Z-axis direction and a transport speed vector σb in the X-axis direction corresponds to a vector of an ink flight speed. The ink ejected from the nozzle N lands at an intersection point of the landing face F2 with an extension of the resultant vector σc. Thus, a landing position x1 where the ink lands at the first distance G1 is offset from a landing position x2 where the ink lands at the second distance G2 by an error ε in the X-axis direction. That is, the ink ejected from the nozzle N lands on the landing face F2 at the second distance G2 after the ink ejected from the nozzle N lands on the landing face F2 at the first distance G1. As can be understood from the above description, an error ε is caused between an actual landing position x and an ideal landing position x due to the shape of the landing face F2. According to the present disclosure, the ejection speed v at the second distance G2 is set to be higher than the ejection speed v at the first distance G1 in consideration of the above circumstances.

The detection section 28 of FIG. 1 measures a distance G between the recording medium 12 and each nozzle N. The detection section 28 is, for example, an optical sensor that includes a light emitting device configured to emit light onto the landing face F2 and a light receiving device configured to receive reflected light from the landing face F2 and that measures a distance G between each of the nozzles N and the recording medium 12.

Figure 5:
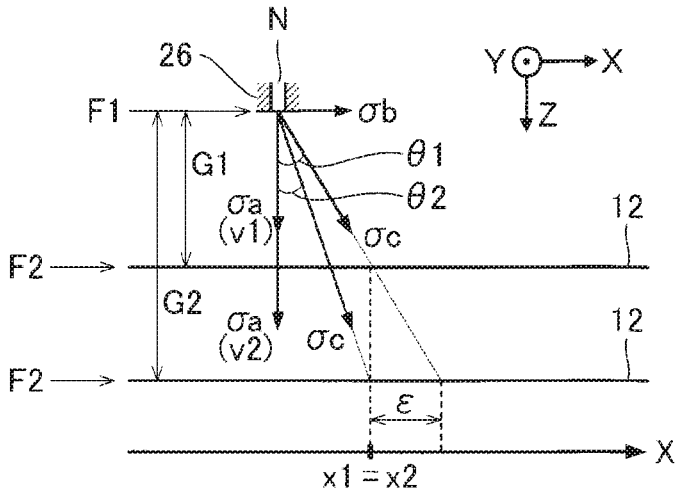
FIG. 5 is an explanatory diagram of a relationship between ejection speed and landing position.

The control unit 20 controls the ejection speed v in response to the distance G measured by the detection section 28. As illustrated in FIG. 5, the control unit 20 performs control such that the ejection speed v is a first speed v1 at the first distance G1 and the ejection speed v is a second speed v2 at the second distance G2 when the distance G may be the first distance G1 and the second distance G2. The second speed v2 is higher than the first speed v1.

When the ejection speed v changes, the ejection amount may change in response to the change in the speed. In such a case, the ejection amount or the density of an image to be recorded on the recording medium differs between the first distance G1 and the second distance G2, and good image quality cannot be achieved. According to the present embodiment, the ejection amount remains unchanged while the ejection speed is switched between the first speed v1 and the second speed v2.

An angle θ formed between the resultant vector σc corresponding to the ink flying speed and the Z-axis changes in response to the ejection speed v. Specifically, an angle 02 formed between the resultant σc and the Z-axis at the second speed v2 is smaller than an angle θ1 formed between the resultant vector σc and the Z-axis at the first speed v1. Thus, as illustrated in FIG. 5, the ink landing position x2 is closer to the nozzle N in the X-axis direction than the ink is ejected at the first speed v1 at the second distance G2 according to the comparative example. That is, the landing position x2 is closer to the landing position x1. Consequently, the error ε of the landing position x caused by the distance G is reduced. As can be understood from the above description, the control unit 20 performs control such that the ejection speed v is higher as the distance G measured by the detection section 28 is greater.

Figure 6:
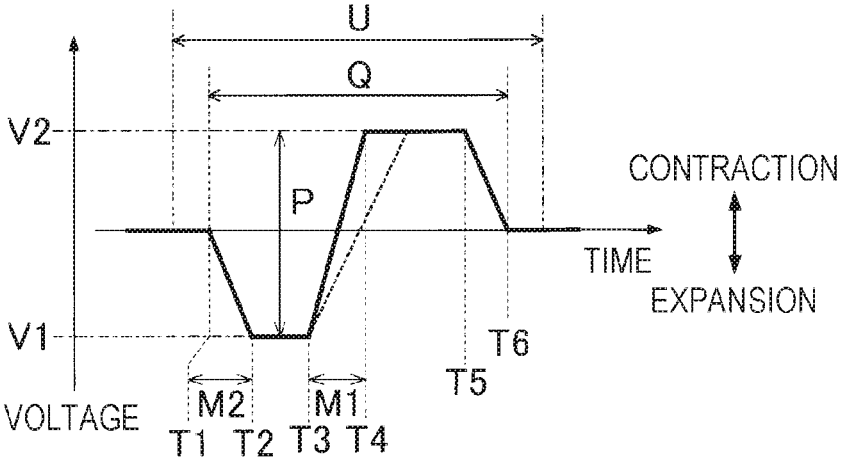
FIG. 6 is a diagram of a waveform of an exemplary drive signal at a second distance.

Specifically, the control unit 20 controls the ejection speed v by changing the shape of the drive waveform Q of FIG. 3 in response to the distance G measured by the detection section 28. The shape of the drive waveform Q is a rate of change (or gradient) of voltage, for example. The control unit 20 changes the rate of change of voltage in the period M1 of the drive waveform Q in which the pressure chambers C contract, for example. As the rate of change of voltage is higher in the period M1, the ejection speed v is higher. In FIG. 6, the solid line illustrates a drive signal COM (second pulse) at the second distance G2 and the broken line illustrates a drive signal COM (first pulse) at the first distance G1. The first pulse has the same shape as that illustrated in FIG. 3. As illustrated in FIG. 6, the control unit 20 generates the drive signals COM so that the rate of change of voltage in the period M1 at the second distance G2 is higher than that in the period M1 at the first distance G1.

In other words, FIG. 6 illustrates that a temporal difference of the second pulse between the third timing T3 and the fourth timing T4 is smaller than that of the first pulse between the third timing T3 and the fourth timing T4. The pressure chambers C contract in the period M1 as described above. The ejection speed can be increased since a liquid pushing speed increases due to an increase in the contraction speed. The first pulse and the second pulse are equal in voltage between the second timing T2 and the third timing T3 and a voltage between the fourth timing T4 and the fifth timing T5. Therefore, the amount of expansion and the amount of contraction of the pressure chambers C do not change between the first pulse and the second pulse, and the ejection amount can be substantially equal therebetween.

A drive signal COM is generated in response to the distance G measured by the detection section 28 in parallel with the movement of the liquid ejecting head 26 and the recording medium 12 by the movement mechanism 22. For example, the shape of the drive signal COM changes each time the distance G is measured by the detection section 28. The drive signal COM generated by the control unit 20 is supplied to the drive elements E via the drive circuit 40. Thus, the ink can be ejected at the ejection speed v in response to the distance G between the recording medium 12 and the nozzle N. As can be understood from the above description, the ejection speed v is switched in response to the distance G in parallel with the movement of the liquid ejecting head 26 and the recording medium 12 by the movement mechanism 22.

Figure 7:
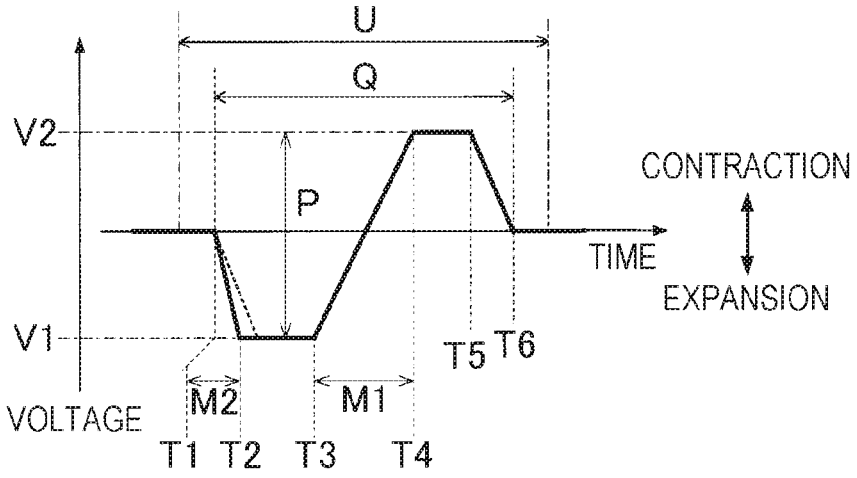
FIG. 7 is a diagram of a waveform of the drive signal at the second distance in another form.

The control unit 20 may change the rate of change of voltage in the period M2 of the drive waveform Q of FIG. 3 in which the pressure chambers C expand. In FIG. 7, the solid line illustrates a drive signal COM (second pulse) at the second distance G2 and the broken line illustrates a drive signal COM (first pulse) at the first distance G1. As the rate of change of voltage in the period M2 is larger, the ejection speed v is higher. Thus, as illustrated in FIG. 7, the control unit 20 generates the drive signals COM so that the rate of change of voltage in the period M2 at the second distance G2 is higher than that in the period M2 at the first distance G1.

In other words, FIG. 7 illustrates that a temporal difference of the second pulse between the first timing T1 and the second timing T2 is smaller than a temporal difference of the first pulse between the first timing T1 and the second timing T2. The pressure chambers C expand in the period M2 as described above. The ejection speed v can be increased by increasing the expansion speed and a meniscus vibration. The voltage of the first pulse and the voltage of the second pulse are equal between the second timing T2 and the third timing T3 and between the fourth timing 14 and the fifth timing T5. Thus, the amount of expansion and the amount of contraction of the pressure chambers C do not change between the first pulse and the second pulse, and the ejection amount can be substantially equal therebetween.

Figure 8:
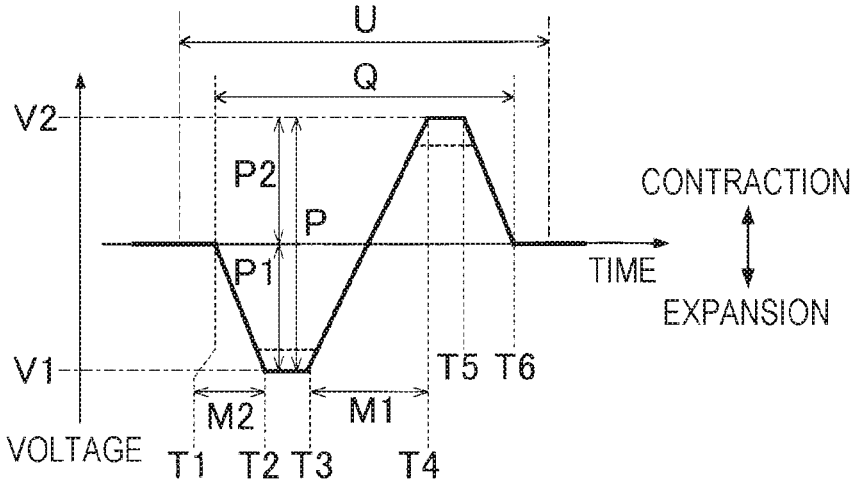
FIG. 8 is a diagram of a waveform of the drive signal at the second distance in still another form.

The control unit 20 may control the ejection speed v by changing the amplitude P of the voltage of the drive waveform Q as a shape of the drive waveform Q. In FIG. 8, the solid line illustrates a drive signal COM at the second distance G2 and the broken line illustrates a drive signal COM at the first distance G1. As the amplitude P is larger, the ejection speed v is higher. As illustrated in FIG. 8, the control unit 20 generates the drive signals COM so that the amplitude P at the second distance G2 is larger than the amplitude P at the first distance G1.

In other words, FIG. 8 illustrates that a voltage difference between the voltage V1 of the second pulse and the reference voltage is larger than a voltage difference between the voltage V1 of the first pulse and the reference voltage. The meniscus vibration increases and the ejection speed increases accordingly. However, the voltage V1 itself is changed, and the amount of meniscus pull-in also increases and the ejection amount decreases. The ejection amount is increased to compensate for the reduction in the ejection amount caused by the larger voltage difference between the voltage V2 of the second pulse and the reference voltage than the voltage difference between the voltage V2 of the first pulse and the reference voltage, the increase in the amount of pushed liquid, and the increase in the amount of meniscus pull-in. Therefore, the ejection speed for the second pulse in FIG. 8 can be made higher than for the first pulse without changing the ejection amount.

As can be understood from the above description, the control unit 20 corresponds to a component configured to control ink ejection by the liquid ejecting head 26 so that the ejection speed v is the first speed v1 at the first distance G1, the ejection speed v is the second speed v2 at the second distance G2, and the ejection amount per ejection is equal between the first distance G1 and the second distance G2. The meaning of "the ejection amount is equal" includes a strictly equal amount of ejection and a substantially equal amount of ejection. The meaning of "the ejection amount is substantially equal" is that the ejection amount is within a range of manufacture error, for example. For example, an ejection amount with an error of 5% or less may be expressed as "the ejection amount is substantially equal".

According to the first embodiment, the ejection speed v is controlled in response to the distance G between the nozzle N and the recording medium 12, thereby reducing the error ε of the landing position x when the distance G changes.

B: Second Embodiment

A second embodiment will be described below. The components having similar functions to those of the first embodiment will be given like reference numerals, and detailed description of each component will be omitted as appropriate.

Figure 9:
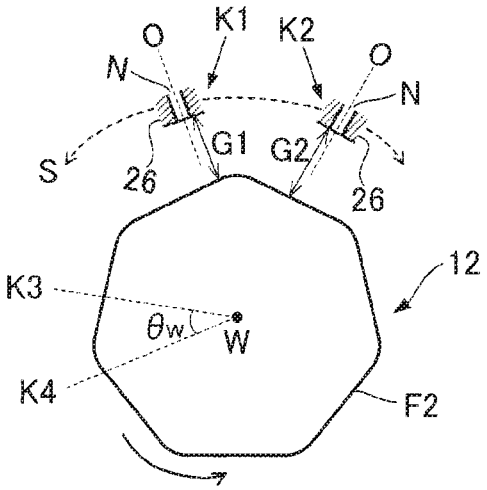
FIG. 9 is a sectional view of a recording medium and the liquid ejecting head according to a second embodiment.

FIG. 9 is a sectional view of the recording medium 12 and the liquid ejecting head 26 according to the second embodiment. In the second embodiment, the recording medium 12 may be a container such as PET bottle or can. As illustrated in FIG. 9, it is assumed that the ink is ejected onto the landing face F2 of the columnar recording medium 12 with a polygonal section, for example.

The first movement section 31 according to the second embodiment rotates a recording medium 12 about a center axis W of the recording medium 12 under control of the control unit 20. The second movement section 32 moves the liquid ejecting head 26 on a curve S along the section of the recording medium 12 while the nozzle N faces the landing face F2 of the recording medium 12. The movement of the recording medium 12 by the first movement section 31 and the movement of the liquid ejecting head 26 by the second movement section 32 are performed concurrently. Both the recording medium 12 and the liquid ejecting head 26 thereby move to eject the ink in the circumferential direction of the landing face F2.

As illustrated in FIG. 9, the second movement section 32 moves the liquid ejecting head 26 to a first position K1 and to a second position K2 different from the first position K1 on the curve S. Thus, a center axis O of the nozzle N of the liquid ejecting head 26 at the first position K1 crosses a center axis O of the nozzle N of the liquid ejecting head 26 at the second position K2 in sectional view. That is, a direction in which the ink is ejected from the liquid ejecting head 26 at the first position K1 is different from a direction in which the ink is ejected from the liquid ejecting head 26 at the second position K2.

The first movement section 31 moves the recording medium 12 to a third position K3 and a fourth position K4 different from the third position K3 about the center axis W. As illustrated in FIG. 9, the first movement section 31 rotates and moves the recording medium 12 by an angle θw from the third position K3 to the fourth position K4, for example. Thus, a portion facing the nozzle N in the recording medium 12 at the third position K3 is different from a portion facing the nozzle N in the recording medium 12 at the fourth position K4.

Also in the second embodiment as in the first embodiment, the distance G between the nozzle N and the recording medium 12 changes in response to the movement of the liquid ejecting head 26 and the recording medium 12. For example, the distance G is the first distance G1 when the liquid ejecting head 26 is at the first position K1 and the distance G is the second distance G2 when the liquid ejecting head 26 is at the second position K2. As in the first embodiment, the second distance G2 is greater than the first distance G1. As in the first embodiment, the control unit 20 controls ink ejection by the liquid ejecting head 26 so that the ejection speed v is the first speed v1 at the first distance G1, the ejection speed v is the second speed v2 at the second distance G2, and the ejection amount per ejection is equal between the first distance G1 and the second distance G2.

Similar effects as in the first embodiment are also achieved in the second embodiment. The direction in which the ink is ejected from the liquid ejecting head 26 at the first position K1 is different from the direction in which the ink is ejected from the liquid ejecting head 26 at the second position K2, and thus the liquid ejecting head 26 can be used for printing on recording mediums 12 of various shapes.

C: Variants

Each of the above-described embodiments can be variously modified. Specific variants applicable to each of the above-described embodiments will be described below by way of example. Two or more variants arbitrarily selected from the following variants may be combined as appropriate when compatible with each other.

(1) The recording medium 12 with the uneven landing face F2 may be used in the first embodiment and the recording medium 12 may be a three-dimensional (3D) container in the second embodiment, for example, but the recording medium 12 is not limited to the above examples. A typical example of the recording medium 12 is a 3D object having an uneven surface. The present disclosure is suitably used when the recording medium 12 is a 3D object. The 3D object is not limited to, for example, print sheets or containers having an uneven landing face F2 and may be various 3D products.

(2) In each of the above-described embodiments, the movement mechanism 22 includes the first movement section 31 and the second movement section 32, but the configuration of the movement mechanism 22 is not limited to the above example. The movement mechanism 22 may include at least one of the first movement section 31 and the second movement section 32. That is, the movement mechanism 22 moves at least one of the liquid ejecting head 26 and the recording medium 12. The direction in which the first movement section 31 moves the recording medium 12 and the direction in which the second movement section 32 moves the liquid ejecting head 26 are not limited to the examples in the above-described embodiments, and the directions may be changed as appropriate depending on the shape and kind of the recording medium 12.

When the recording medium 12 is a sheet of roll paper or the like, the recording medium 12 may be curled, for example. Consequently, the present disclosure is suitably used even when the distance G changes due to a change in shape of the recording medium 12.

(3) The control unit 20 may control the ejection speed v in the following exemplary way. A numerical range assumed for the distance G between the nozzle N and the recording medium 12 is divided into two or more periods Rn (n=1 to N). For example, the distance G is greater in the period Rn than in the period Rn−1. The control unit 20 specifies one of the periods R to which the distance G measured by the detection section 28 corresponds and switches the ejection speed v to the ejection speed vn based on the period R. For example, the control unit 20 switches the ejection speed v to any one of the ejection speeds vn corresponding to the periods R. The ejection speed vn is higher than the ejection speed vn−1. In the configuration, for example, the distance G is the first distance G1 in the period Rn1 and the distance G is the second distance G2 in the period Rn2 (n1<n2).

In the configuration, the liquid ejecting apparatus 100 may store in advance drive signals COMn corresponding to ejection speeds vn. The control unit 20 supplies the drive circuit 40 with a drive signal COMn corresponding to a period Rn among the drive signals COMn. Thus, the ink is ejected at the ejection speed vn based on the period R.

(4) The liquid ejecting apparatus 100 described in each of the above-described embodiments may be used for various devices such as facsimile machines or copying machines in addition to printing-only devices. The applications of the liquid ejecting apparatus are not limited to printing. For example, a liquid ejecting apparatus configured to eject a solution of color material is used as a manufacturing apparatus configured to form a color filter of a display apparatus such as liquid crystal display panel. A liquid ejecting apparatus configured to eject a solution of conductive material is used as a manufacturing apparatus configured to form a wiring or an electrode of a wiring substrate. A liquid ejecting apparatus configured to eject a solution of bioorganic material is used as a manufacturing apparatus configured to manufacture a biochip, for example.

(5) In each of the above-described embodiments, the liquid ejecting apparatus 100 includes the detection section 28 and is configured such that the detection section 28 performs the detection operation at the same time as the liquid ejecting operation and measures a distance between a recording medium and a nozzle, but may operate in other ways. For example, the liquid ejecting apparatus 100 is not limited to including the detection section 28 and may store in advance, in the liquid ejecting head or the storage section, a surface shape of a recording medium or a change in distance between a recording medium and a nozzle before the start of the ejecting operation.

What is claimed is:

1. A liquid ejecting apparatus comprising:

a liquid ejecting head with a nozzle configured to eject a liquid; and a control section configured to control ejection of the liquid by the liquid ejecting head, wherein the control section controls ejection of the liquid by the liquid ejecting head so that an ejection speed of the liquid from the nozzle is a first speed when a distance between the nozzle and a recording medium is a first distance, the ejection speed is a second speed higher than the first speed when the distance between the nozzle and the recording medium is a second distance greater than the first distance, and an ejection amount per ejection from the nozzle when the distance between the nozzle and the recording medium is the first distance is equal to an ejection amount per ejection from the nozzle when the distance between the nozzle and the recording medium is the second distance, wherein the liquid ejecting head includes an energy generating element corresponding to the nozzle and configured to generate energy for ejecting the liquid, the control section ejects a liquid from the nozzle by applying a first pulse to the energy generating element when the distance between the nozzle and the recording medium is the first distance and by applying a second pulse to the energy generating element when the distance between the nozzle and the recording medium is the second distance, and the first pulse and the second pulse decrease voltage in a period from a first timing to a second timing, increase voltage in a period from a third timing to a fourth timing after the second timing, and decrease voltage in a period after a fifth timing after the fourth timing, wherein a temporal difference of the second pulse between the third timing and the fourth timing is smaller than a temporal difference of the first pulse between the third timing and the fourth timing.

2. The liquid ejecting apparatus according to claim 1, further comprising:

a detection section configured to detect the distance between the nozzle and the recording medium, wherein the control section controls a speed at which the liquid ejecting head ejects the liquid in response to the distance measured by the detection section.

3. The liquid ejecting apparatus according to claim 1, further comprising:

a movement mechanism configured to move at least one of the liquid ejecting head and the recording medium, wherein the control section changes the ejection speed in response to the distance between the nozzle and the recording medium while the movement mechanism performs moving.

4. The liquid ejecting apparatus according to claim 3, wherein the movement mechanism moves the liquid ejecting head to a first position and a second position different from the first position, and a direction in which the liquid is ejected from the liquid ejecting head at the first position is different from a direction in which the liquid is ejected from the liquid ejecting head at the second position.

5. The liquid ejecting apparatus according to claim 3, wherein the movement mechanism moves the recording medium to a third position and a fourth position different from the third position, and a portion facing the nozzle in the recording medium at the third position is different from a portion facing the nozzle in the recording medium at the fourth position.

6. The liquid ejecting apparatus according to claim 1, wherein the recording medium is a three-dimensional object.

7. A liquid ejecting apparatus comprising:

a liquid ejecting head with a nozzle configured to eject a liquid; and a control section configured to control ejection of the liquid by the liquid ejecting head, wherein the control section controls ejection of the liquid by the liquid ejecting head so that an ejection speed of the liquid from the nozzle is a first speed when a distance between the nozzle and a recording medium is a first distance, the ejection speed is a second speed higher than the first speed when the distance between the nozzle and the recording medium is a second distance greater than the first distance, and the liquid ejecting head includes an energy generating element corresponding to the nozzle and configured to generate energy for ejecting the liquid, the control section ejects a liquid from the nozzle by applying a first pulse to the energy generating element when the distance between the nozzle and the recording medium is the first distance and by applying a second pulse to the energy generating element when the distance between the nozzle and the recording medium is the second distance, and the first pulse and the second pulse decrease voltage in a period from a first timing to a second timing, increase voltage in a period from a third timing to a fourth timing after the second timing, and decrease voltage in a period after a fifth timing after the fourth timing, and wherein a temporal difference of the second pulse between the third timing and the fourth timing is smaller than a temporal difference of the first pulse between the third timing and the fourth timing.

8. The liquid ejecting apparatus according to claim 7, wherein a temporal difference of the second pulse between the first timing and the second timing is smaller than a temporal difference of the first pulse between the first timing and the second timing.

9. The liquid ejecting apparatus according to claim 7, further comprising:

a movement mechanism configured to move at least one of the liquid ejecting head and the recording medium, wherein the control section changes the ejection speed in response to the distance between the nozzle and the recording medium while the movement mechanism performs moving.

10. The liquid ejecting apparatus according to claim 9, wherein the movement mechanism moves the liquid ejecting head to a first position and a second position different from the first position, and a direction in which the liquid is ejected from the liquid ejecting head at the first position is different from a direction in which the liquid is ejected from the liquid ejecting head at the second position.

* * * * *